United States Patent [19]

Thivans

[11] Patent Number: 4,912,794

[45] Date of Patent: Apr. 3, 1990

[54] BRIDGE HAVING CHORDS CONNECTED TO EACH OTHER BY MEANS OF PLEATED STEEL SHEETS

[75] Inventor: René Thivans, Gif Sur Yvette, France

[73] Assignee: Campenon Bernard BTP, Clichy, France

[21] Appl. No.: 165,116

[22] Filed: Mar. 7, 1988

[30] Foreign Application Priority Data

Mar. 11, 1987 [FR] France ..... 87 03337

[51] Int. Cl.[4] ..... E01D 1/00

[52] U.S. Cl. ..... 14/3; 14/4; 14/17

[58] Field of Search ..... 14/1, 3, 4, 6, 13, 14, 14/17, 73; 52/174, 262, 263, 630, 723, 731; 104/118, 119, 124, 125; 105/141, 144; 238/5, 7, 87, 95, 98

[56] References Cited

U.S. PATENT DOCUMENTS

| | | | |
|---|---|---|---|
| 2,125,691 | 8/1939 | Ragsdale et al. | 52/731 |
| 3,103,025 | 9/1963 | Gassner et al. | 14/73 X |
| 3,257,764 | 6/1966 | Cripe | 52/174 X |
| 3,849,237 | 11/1974 | Zetlin | 14/73 X |
| 3,872,532 | 3/1975 | Cornelius et al. | 52/174 X |
| 3,999,354 | 12/1976 | Anter et al. | 52/731 |
| 4,713,924 | 12/1987 | Toti | 52/731 |

FOREIGN PATENT DOCUMENTS

| | | | |
|---|---|---|---|
| 76977 | 10/1893 | Fed. Rep. of Germany . | |
| 1211240 | 2/1966 | Fed. Rep. of Germany | 14/17 |
| 2156017 | 5/1973 | Fed. Rep. of Germany . | |
| 2744367 | 4/1979 | Fed. Rep. of Germany . | |
| 2810934 | 9/1979 | Fed. Rep. of Germany . | |
| 784806 | 7/1935 | France . | |
| 1246528 | 10/1960 | France . | |
| 2108984 | 5/1972 | France . | |
| 2494400 | 5/1982 | France | 14/6 |
| 326084 | 1/1958 | Switzerland . | |
| 378504 | 7/1964 | Switzerland | 14/17 |
| 831893 | 5/1981 | U.S.S.R. | 14/17 |
| 984683 | 3/1965 | United Kingdom | 14/73 |

OTHER PUBLICATIONS

"Bilan de la politique d'innovation dans le domaine des ouvrages d'art", *Travaux*, No. 597, by M. Virlogeux, Mar., 1985, paragraph 2.2, pp. 23–28.

*Primary Examiner*—Jerome W. Massie
*Assistant Examiner*—Matthew Smith
*Attorney, Agent, or Firm*—Young & Thompson

[57] ABSTRACT

A bridge designed to afford enhanced resistance to shearing forces has at least one top chord (1) of concrete and a bottom chord (2) of concrete or of metal connected to each other by means of structural elements designed to resist shearing forces. These structural elements include two pleated or corrugated continuous steel sheets (3, 4) placed on each side of a vertical mid-plane (P) of the bridge. The pleats or corrugations extend in a direction which is substantially perpendicular to the length of the bridge.

9 Claims, 4 Drawing Sheets

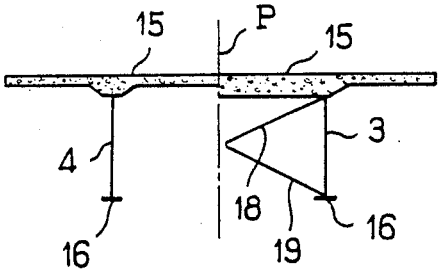
FIG_4
FIG_5
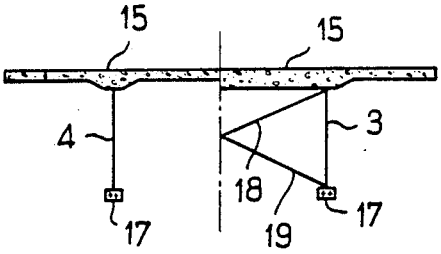
FIG_6
FIG_7
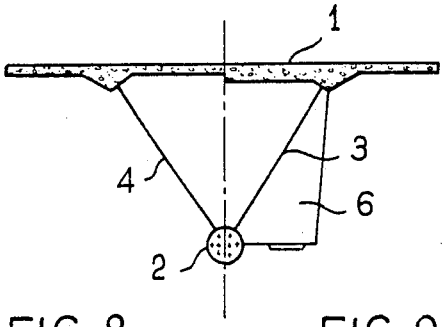
FIG_8
FIG_9
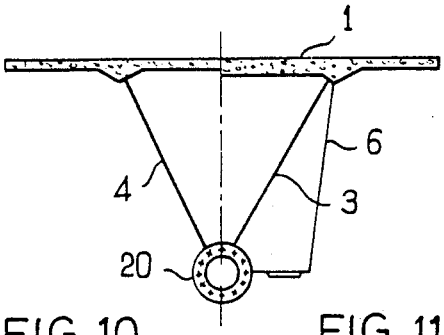
FIG_10
FIG_11
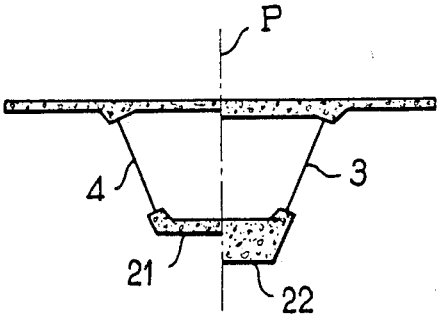
FIG_12
FIG_13
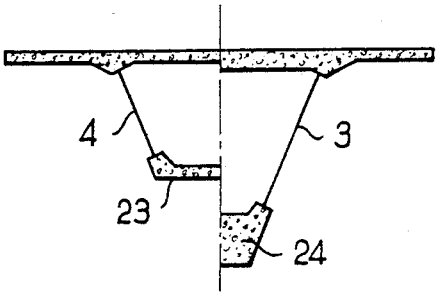
FIG_14
FIG_15
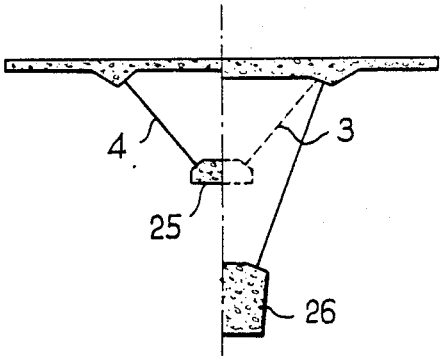
FIG_16
FIG_17

BRIDGE HAVING CHORDS CONNECTED TO EACH OTHER BY MEANS OF PLEATED STEEL SHEETS

BACKGROUND OF THE INVENTION

1. Field of the Invention

The present invention relates to a bridge having at least one top chord of concrete and a bottom chord of concrete or of metal, said chords being connected to each other by means of structural elements which resist shearing forces.

The two bridge members or chords transmit the moments whilst the structural elements or webs placed between these chords transmit the shearing forces.

2. Description of the Prior Art

In known bridge designs, the webs are constituted by a series of bars arranged in an N-shaped structure. Some of these bars work in compression whilst others work in tension.

The chords and the webs can be of concrete and/or of steel.

In other known designs such as those disclosed, for example, in Swiss patent No. 378,504 and in French patent Application No. 2,494,400, the webs disposed between the chords are constituted by elements of pleated sheet steel. These steel sheets are non-continuous or in other words separated from each other in the direction of the length of the bridge.

In all known designs, should it be desired to obtain webs which are capable of transmitting high shearing forces, it is necessary to increase the number of webs and/or to increase the thickness of these latter. Thus in the case of structures which are intended to sustain very high shearing forces, the construction is heavy and consequently difficult to carry into effect.

The aim of the present invention is to provide a bridge which affords resistance to very high shearing forces while being of lightweight design and easy to construct.

SUMMARY OF THE INVENTION

In accordance with the invention, a bridge having at least one top chord of concrete and a bottom chord of concrete or of metal connected to each other by means of structural elements which afford resistance to shearing forces is distinguished by the fact that the structural elements aforesaid include two pleated or corrugated continuous steel sheets placed on each side of a vertical mid-plane of the bridge, the pleats or corrugations being adapted to extend in a direction which is substantially perpendicular to the length of the bridge.

It has been established by the present Applicant that the fact of replacing known webs of non-continuous pleated steel sheets as disclosed in Swiss Pat. No. 378,504 and in French patent Application No. 2,494,400 by webs of pleated or corrugated continuous steel sheets makes it possible to achieve considerably enhanced resistance of the structure to shearing forces.

Thus the invention permits the construction of a bridge which is capable of withstanding high shearing forces by making use of pleated steel sheets which are of light weight and therefore easy to employ.

In a preferred embodiment of the invention, the continuous steel sheets are made up of two series of flat strips located in two parallel planes, the strips of one of the series being joined to the strips of the other series by means of flat strips which make a predetermined angle with these latter, the junction between the strips being constituted by an arris.

This structure endows the pleated steel sheet with excellent resistance to shearing forces, even when the thickness of said steel sheet is reduced to a few millimeters.

In the application considered in the present invention, the thickness of the steel sheets is within the range of 8 to 12 mm, the amplitude of the pleats is within the range of 10 to 30 cm and the dimension of the steel sheets measured in the direction of said pleats is within the range of 2 to 12 m.

BRIEF DESCRIPTION OF THE DRAWINGS

FIGS. 4 to 17 are schematic views in transverse cross-section showing different alternative embodiments of the invention.

DESCRIPTION OF THE PREFERRED EMBODIMENTS

Figure 1:
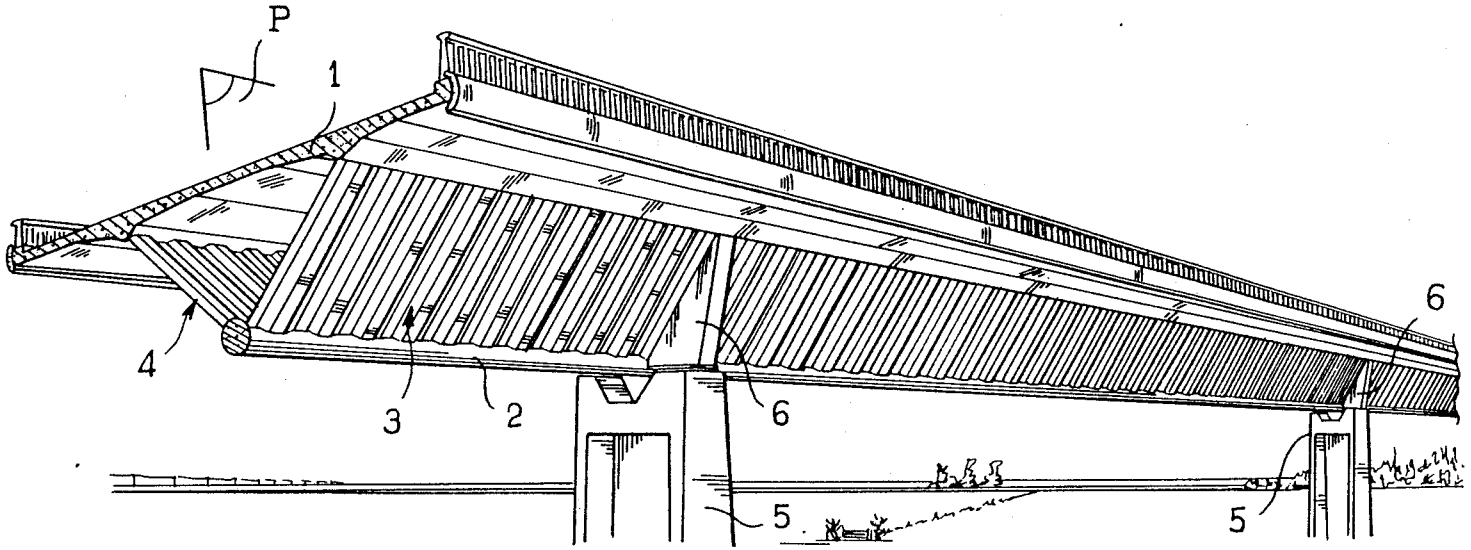
FIG. 1 is a partial view in perspective showing a bridge in accordance with the invention.

In the embodiment of FIG. 1, the bridge in accordance with the invention has a top chord consisting of a concrete slab 1 and a bottom chord consisting of a concrete beam 2 which is connected to the slab 1 by means of two continuous pleated steel sheets 3, 4 disposed on each side of a vertical mid-plane P of the bridge whilst the pleats or corrugations extend in a direction substantially perpendicular to the length of the bridge.

Figure 2:
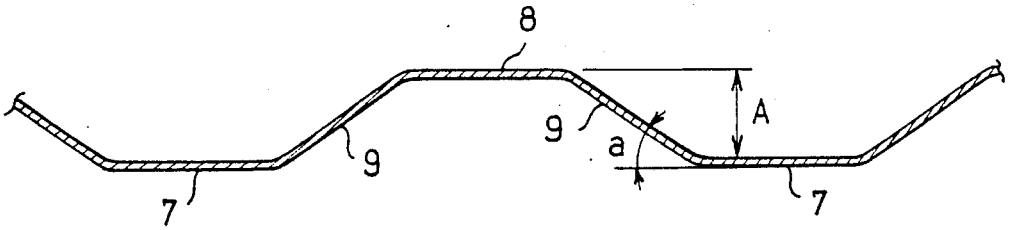
FIG. 2 is a view in transverse cross-section showing a pleated steel sheet employed in the bridge in accordance with the invention.

In the example illustrated in FIG. 1, the assembly constituted by the slab 1, the beam 2 and the pleated steel sheets 3, 4 rests on concrete piers 5 by means of lateral bearing blocks 6 extending between the slab 1 and the beam 2. As is apparent from FIG. 2, the continuous steel sheets 3, 4 each have two series of flat strips 7, 8 located in two parallel planes, the strips 7 of one of the series being joined to the strips of the other series by means of flat strips 9 which make a predetermined angle (equal to 37° in the example shown) with these latter, the junction between the strips being constituted by an arris.

Depending on the forces which the bridge is designed to withstand, the thickness of the steel sheets 3, 4 can vary between 8 and 12 mm, the amplitude A of the pleats 7, 9 ; 9, 8 can vary between 10 and 30 cm and the dimension of the steel sheets as measured in the longitudinal direction of these pleats can vary between 2 and 12 m. Moreover, the width of the strips 7, 8, 9 can vary between 0.25 and 0.50 m.

In the case of the embodiment shown in FIG. 1, the assembly constituted by the slab 1, the two pleated steel sheets 3, 4 and the bottom beam 2 forms a tubular structure having a constant triangular cross-section. In view of the fact that the pleated steel sheets 3, 4 are continuous, the lateral surface of the assembly aforesaid is completely closed.

Figure 3:
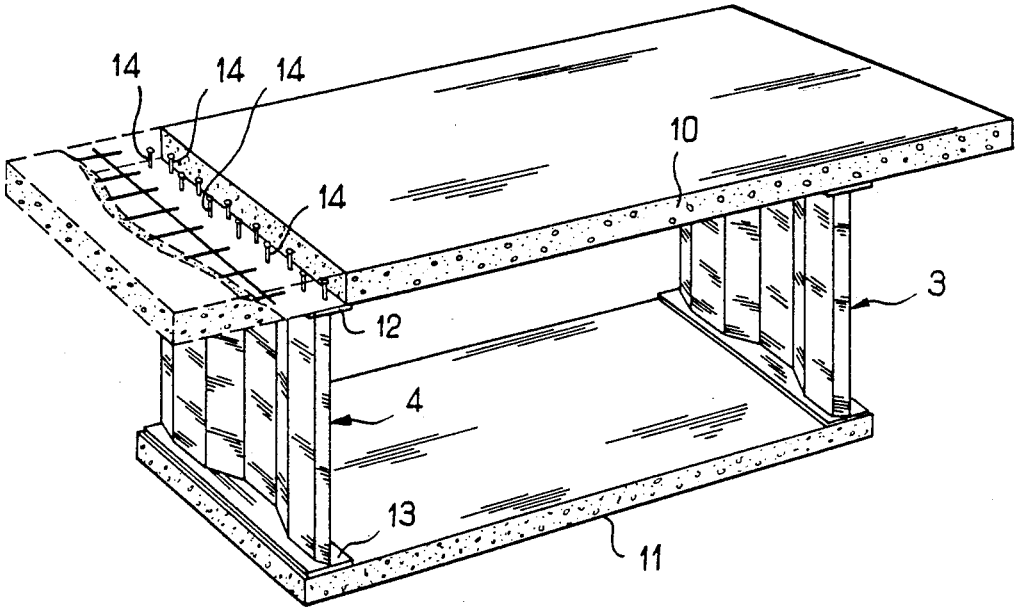
FIG. 3 is a partial view in perspective showing an alternative embodiment of a bridge in accordance with the invention.

This is also the case with the bridge shown in FIG. 3. In this example, the top and bottom chords are constituted by parallel slabs 10, 11 of concrete. These slabs are connected to each other by means of two pleated steel sheets 3, 4 which are identical with those of the embodiment shown in FIG. 1.

It is further apparent from FIG. 3 that each pleated steel sheet 3, 4 is fitted at each edge adjacent to the slabs 10, 11 with a plate 12, 13 located at right angles to the general plane of the steel sheets 3, 4 and projecting on each side of said plane. On the face which is oriented towards the exterior, each plate 12, 13 is provided with a series of metallic connectors 14 which are embedded in the concrete of the slabs 10, 11.

Thus the steel sheets 3, 4 are securely anchored to the slabs 10, 11.

The mode of connection described in the foregoing can also be adopted in the case of the embodiment shown in FIG. 1.

The continuous steel sheets 3, 4 are not usually of single-piece construction along the full length of the bridge. These sheets are preferably constituted by pleated steel-sheet elements formed in one piece in the direction perpendicular to the length of the bridge and attached to each other in the direction of the length of the bridge by welding, riveting, bolting or the like.

The alternative embodiments shown in FIGS. 4 to 17 have as a common feature the fact that the top chord is a concrete slab 1, 15.

In the alternative embodiments illustrated in FIGS. 4 to 7, the bottom chords are constituted by two metallic beams 16 (as shown in FIGS. 4, 5) or concrete beams 17 (as shown in FIGS. 6, 7), the pleated steel sheets 3, 4 being perpendicular to the slab 15.

In the case of FIGS. 5 and 7, two additional pleated steel sheets 18, 19 extend respectively from the edges of the steel sheet 3 which are adjacent to the slab 15 and to the beam 16 or 17 and form a dihedron, the vertex of which is located in the vertical plane P of symmetry of the bridge.

The two steel sheets 18, 19 which form a dihedron as stated above permit reinforcement of the structure.

FIGS. 8 and 9 are transverse sectional views of the embodiment shown in FIG. 1.

FIGS. 10 and 11 are similar to FIGS. 8 and 9. The difference lies in the fact that the concrete beam 20 which constitutes the bottom chord is of hollow construction and of larger diameter than the beam 2 of FIGS. 1, 8 and 9.

In the embodiments of FIGS. 12 to 17, the bottom chord is constituted by a concrete slab 21, 22, 23, 24, 25, 26 of variable width which is smaller than that of the top slab 15. The pleated steel sheets 3, 4 disposed symmetrically on each side of the vertical plane P of the bridge are inclined at a predetermined angle with respect to this plane.

Among the advantages offered by all the embodiments described in the foregoing are the fact that they are easy to carry out, involve relatively low cost, and are of lightweight construction while at the same time affording distinctly higher resistance to shearing forces than known structures which make use of non-continuous pleated steel sheets in accordance with Swiss patent No. 378,504 and French patent Application No. 2,494,400, as will be demonstrated hereinafter.

Figure 18:
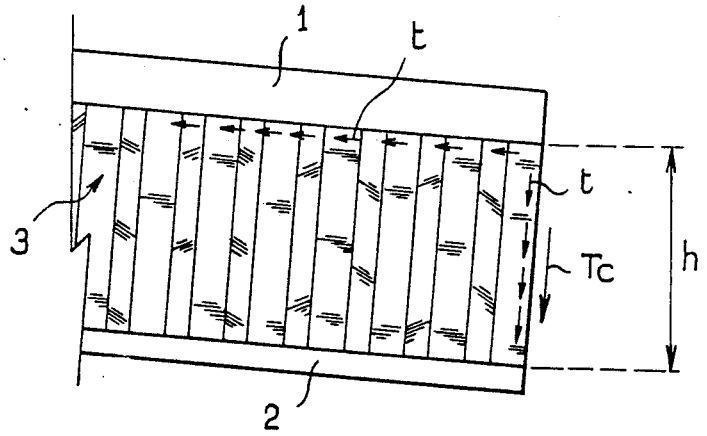
FIG. 18 is a partial schematic side view of a bridge in accordance with the invention and showing how the continuous pleated steel sheet transmits applied forces.

In a web of continuous pleated steel sheet 3 (as shown in FIG. 18), applied shearing forces give rise to a uniform field of shear stresses t. Dimensioning of a structure of this type consists in making sure that the shear stress t is lower on the one hand than the buckling stress tv with a suitable safety factor k and lower on the other hand than the permissible value of shear stress tm in the case of steel, namely :

$$t < tv/k \quad (1)$$

$$t < tm \quad (2)$$

Figure 19:
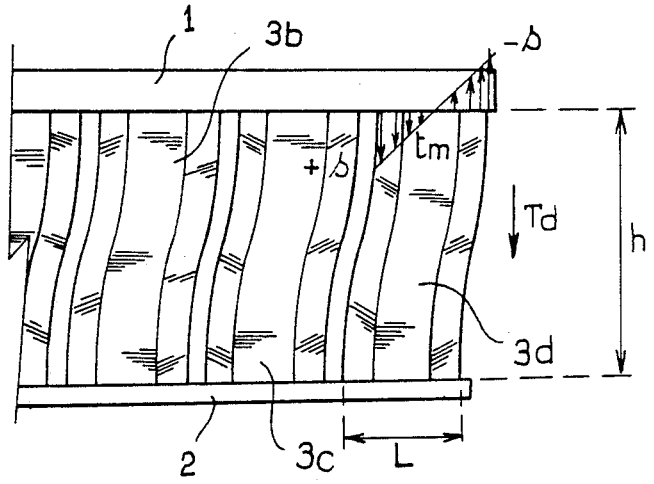
FIG. 19 is a view which is similar to FIG. 18 and illustrates the case of a known bridge constructed with non-continuous pleated steel sheets.

In a web of non-continuous pleated steel sheet **3*b*, 3*c*, 3*d* (as shown in FIG. 19**), the applied shearing forces also give rise to shear stresses t but to these are added longitudinal compressive and tensile stresses s (namely stresses parallel to the generator-line of the pleats) which arise from the bending moment which acts upon each web element (so-called "ladder beam" behavior). For the dimensioning of a structure of this type, it is necessary to ensure that the shear stress t is lower than the permissible value tm, that stability remains guaranteed under the combined action of shear stresses and compressive stresses and finally that the compressive stresses are lower than the permissible value sm, namely:

$$f(t, s) < \mathrm{fm} \quad (4)$$

$$t < tm \quad (5)$$

$$s < sm \quad (6)$$

Condition (4) is more rigorous than condition (1) but in the case of bridge webs, it is condition (6) which imposes a heavy penalty on non-continuous webs.

Consideration will now be given by way of example to the case of a common type of bridge having a span of 60 m. The height h of the web is approximately 1/20 of the span, namely 3.0 m.

The web of continuous pleated steel sheet has the following characteristics :

thickness: e=0.008 m
width of a panel: 1=0.3 m
amplitude: a=0.18 m
height of web: h=3.0 m This web of continuous pleated steel sheet is capable of affording resistance to a shearing force $T_c$ which has the value:

$$T_c = tm \times e \times h. \text{ whereas } tm = 0.42\ se$$

$$se = 360 \text{ Mpa (elastic limit of steel)}$$

$$\text{whence : } T_c = 0.42 \times 360 \times 0.008 \times 3 = 3.63\ MN$$

$$T_c = 3.63\ MN = 370 \text{ tons.}$$

The non-continuous web having the same characteristics (see FIG. 19) affords resistance to a shearing force $T_d$; each web element has a total width L=0.5 m and an inertia I $$I = e \times L^3/12 = 0.008 \times 0.53/12 = 0.0000833\ m^4$$

The web elements are subjected to bending moments M which are of maximum value at the ends, at which they have the following value :

$$M = +T_d.\ L/h \times H/2 = +0.25\ T_d$$

To these moments correspond compressive and tensile stresses:

$$s = M/I \times L/2 = 0.25/0.0000833 = 0.5/2 \times T_d = 750\ T_d$$

Furthermore : $sm = se/1.15 = 313$ MPa

Condition (6) gives :

$$740\ T_d \leqq 313$$

$$T_d \leqq 0.417\ MN = 42.5 \text{ tons.}$$

It is observed that the ratio $T_c/T_d$ is very high:

$$T_c/T_d = 370/42.5 = 8.7$$

Thus, in respect of identical dimensioning, a web of continuous steel sheet in accordance with the present invention is capable of transmitting a shearing force more than eight times the magnitude of the force which can be transmitted by a web of non-continuous steel sheet.

As can readily be understood, the invention is not limited to the examples of construction described in the foregoing and a large number of modifications may accordingly be contemplated without thereby departing either from the scope or the spirit of the invention.

Thus, each bridge could have more than two continuous pleated steel sheets between the top chord and the bottom chord or chords.

What is claimed is:

1. A bridge having at least one top chord of concrete (1, 10, 15) and a bottom chord of concrete or of metal (2, 11, 16, 17, 20, 21) connected to each other by means of structural elements which afford resistance to shearing forces, wherein the structural elements aforesaid consist essentially of two pleated or corrugated continuous steel sheets (3, 4) extending substantially along the whole length of the bridge and placed on each side of a vertical mid-plane (P) of the bridge, the pleats or corrugations extending in a direction which is substantially perpendicular to the length of the bridge, said two pleated or corrugated continuous steel sheets (3, 4) being adapted to support all the shearing stresses ($T_c$) perpendicular to said chords.

2. A bridge according to claim 1, wherein the continous steel sheets (3, 4) are made up of two series of flat strips (7, 8) located in two parallel planes, the strips of one of the series being joined to the strips of the other series by means of flat strips (9) which make a predetermined angle with said flat strips (7, 8) of the two series, the junction between the strips being constituted by an arris.

3. A bridge according to claim 1, wherein the thickness of the steel sheets (3, 4) is within the range of 8 to 12 mm, the amplitude of the pleats is within the range of 10 to 30 cm and the dimension of the steel sheets measured in the direction of said pleats is within the range of 2 to 12 m.

4. A bridge according to claim 1, wherein said bridge has a top chord constituted by a concrete slab (1, 10, 15) and two bottom chords constituted by two parallel beams (16, 17) each connected to the concrete slab by means of a continuous pleated steel sheet (3, 4).

5. A bridge according to claim 1, wherein said bridge has a top chord constituted by a concrete slab (1, 10, 15) and a single bottom chord constituted by a beam (2, 20) of concrete or of metal or by a metallic tube filled with concrete, said beam being connected to the concrete slab by means of two continuous pleated steel sheets (3, 4).

6. A bridge according to claim 1, wherein the continuous pleated steel sheets (3, 4) form with the chords a tubular structure having an entirely closed peripheral lateral surface.

7. A bridge according to claim 1, wherein the continuous pleated steel sheets (3, 4) are constituted by pleated steel-sheet elements formed in one piece in the direction at right angles to the length of the bridge and attached to each other in the direction of the length of the bridge.

8. A bridge according to claim 1, wherein each pleated steel sheet (3, 4) is provided at each edge adjacent to the chords (10, 11) with a plate (12, 13) located at right angles to the general plane of the steel sheet and projecting on each side of said plane, said plate (12, 13) being provided on that face which is oriented towards the exterior of the bridge with a series of connectors (14) which are attached to the chords.

9. A bridge according to claim 8, wherein the connectors (14) are embedded in the concrete of at least one of the two chords.

* * * * *